United States Patent [19]

Milum

[11] 4,089,661

[45] May 16, 1978

[54] TWO STAGE ELECTROSTATIC PRECIPITATOR

[75] Inventor: Jimmy L. Milum, Harrison, Ark.

[73] Assignee: Emerson Electric Co., St. Louis, Mo.

[21] Appl. No.: 758,610

[22] Filed: Jan. 12, 1977

[51] Int. Cl.[2] ..... B03C 3/08

[52] U.S. Cl. ..... 55/137

[58] Field of Search ..... 55/136–138, 55/146, 154

[56] References Cited

U.S. PATENT DOCUMENTS

| | | | |
|---|---|---|---|
| 2,639,781 | 5/1953 | Savitz | 55/138 |
| 2,662,608 | 12/1953 | Fields | 55/138 |
| 2,780,305 | 2/1957 | Bonatz | 55/146 |
| 2,789,657 | 4/1957 | Fields | 55/137 |
| 2,798,572 | 7/1957 | Fields | 55/137 |
| 2,900,042 | 8/1959 | Coolidge, Jr. et al. | 55/146 |
| 3,016,980 | 1/1962 | Gonzalez | 55/137 |
| 3,018,844 | 1/1962 | Gonzalez | 55/146 |
| 3,026,964 | 3/1962 | Penney | 55/137 |
| 3,175,341 | 3/1965 | Winter | 55/154 |
| 3,707,828 | 1/1973 | Burney | 55/154 |
| 4,018,578 | 4/1977 | Ahlrich | 55/138 |

FOREIGN PATENT DOCUMENTS

| | | | |
|---|---|---|---|
| 1,022,859 | 3/1966 | United Kingdom | 55/138 |
| 846,522 | 8/1960 | United Kingdom | 55/136 |

*Primary Examiner*—Frank W. Lutter
*Assistant Examiner*—David L. Lacey
*Attorney, Agent, or Firm*—Charles E. Markham

[57] ABSTRACT

An electrostatic precipitator having an ionizing section including a series of positively charged fine wires in equally spaced parallel relationship and a collector section including alternate positive and negative plates equally spaced and parallel with the ionizing wires and in which three negative plates of the collector section are extended into the ionizing section adjacent each wire to provide three electrostatic fields.

3 Claims, 8 Drawing Figures

TWO STAGE ELECTROSTATIC PRECIPITATOR

This invention relates to electrostatic precipitators of the two stage type adapted to cleaning air and particularly to means for increasing the ionizing field.

It is customary in the construction of two stage electrostatic precipitators for removing particles from an air stream to extend two negative collector plates of the collector section into the ionizing section, one on each side of a positively charged ionizing wire to create an electrostatic ionizing field between the wire and the flat surface of each of the plates. It has also been proposed to extend positively charged plates of the collector section into the ionizing section to intersect the electrostatic fields existing between the positively charged ionizing wires and the extended negative plates thereby to intensify these fields by the distortion or compression thereof, see U.S. Pat. No. 2,662,608 to A. C. Fields.

An object of the present invention is to provide a generally new and improved electrostatic precipitator for removing particulate matter from an air stream in which the usual ionizing fields between a positively charged wire and the surfaces of two negative plates on opposite sides thereof are augmented by a third ionizing field.

Other objects and advantages will appear from the following description when read in connection with the accompanying drawings.

Figure 2:
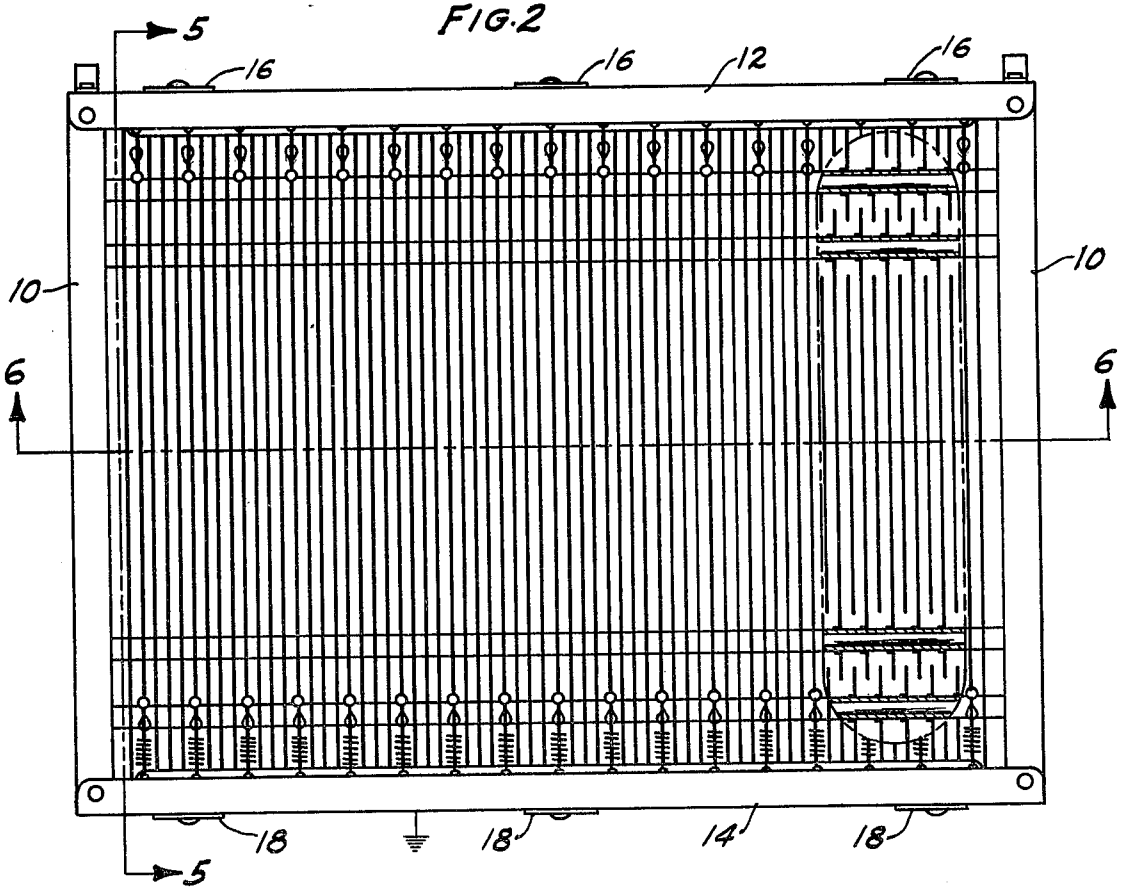
FIG. 2 is a front elevational view of the device shown in FIG. 1, with an oval shaped portion thereof shown in cross section.
Figure 4:
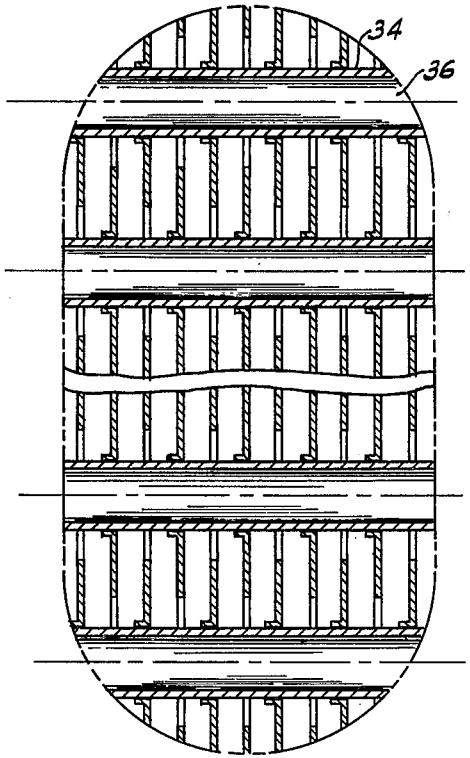
FIG. 4 is an enlarged view of the oval cross sectionalized portion of FIG. 2.

Referring to the drawings in more detail, the device comprises a rigid rectangular metal frame comprising two channel upright members 10, two upper and two lower horizontal angle members 12 and 14, respectively, and three upper and three lower transverse horizontal tie plates 16 and 18, respectively. The upright channel members 10 and horizontal angle members 12 are riveted together and the tie plates 16 and 18 are riveted to the upper and lower horizontal angle members 12 and 14. In operation the device is installed so that the air stream to be cleaned enters the front or inlet side shown in FIG. 2 and emerges from the opposite outlet side as indicated by arrows in FIGS. 3 and 5.

Figure 5:
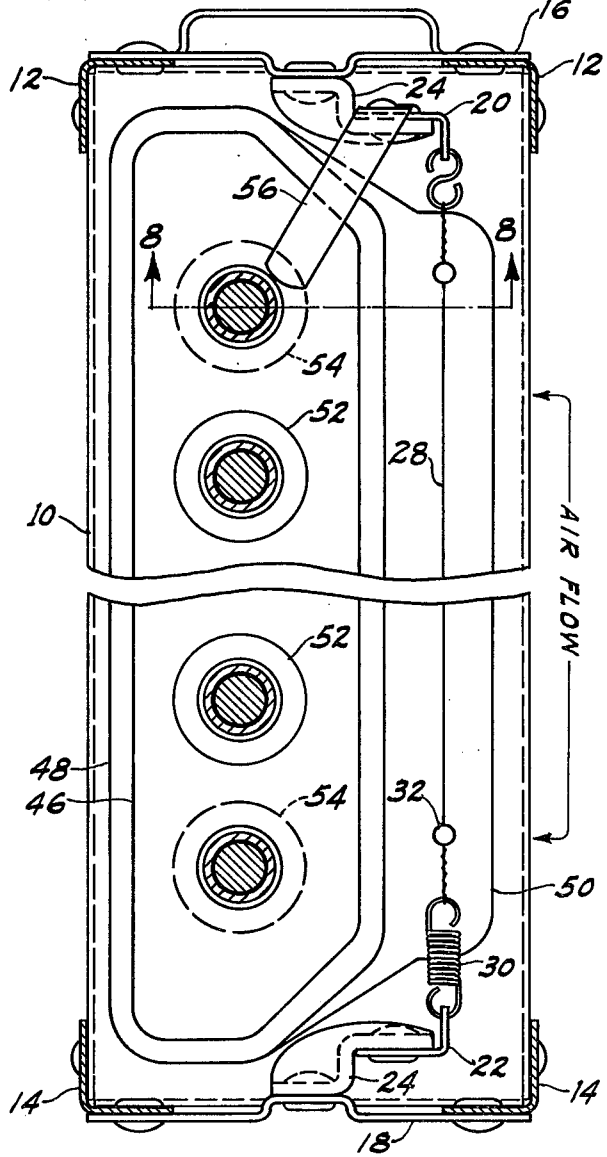
FIG. 5 is an enlarged cross sectional view taken along line 5—5 of FIG. 2.

Upper and lower horizontal metal angle members 20 and 22 positioned near the inlet side of the device, see FIG. 5, are connected to the upper and lower tie plates 16 and 18, respectively, by brackets 24 of dielectric material. The dielectric brackets 24 are riveted to tie plates 16 and 18 and the horizontal legs of metal angles 20 and 22 are riveted to the dielectric brackets. Angles 20 and 22 are therefore electrically insulated from the frame. A series of equally spaced small diameter tungsten wires 28 are connected at their ends to the vertical legs of upper and lower angle members 20 and 22. A spring 30 at the lower end of wires 28 maintains a desired tension. Split lead B—B shot 32 are clamped over the twisted ends of wires 28 to preclude arcing. The tungsten wires 28 together with extended portions of collector plates to be described hereinafter comprise the ionizing section adjacent the front or inlet side of the device.

Figure 7:
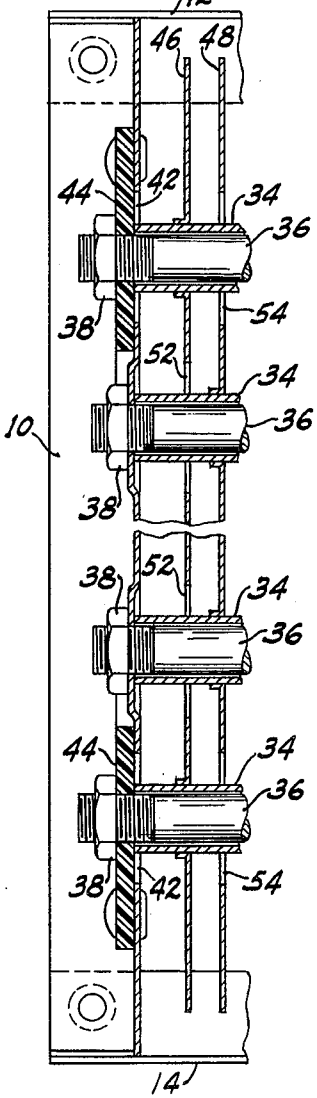
FIG. 7 is an enlarged fragmentary cross sectional view taken along line 7—7 of FIG. 1.

Four horizontal, vertically aligned, conductive metal tubes 34, preferably aluminum, extend between the webs of channel uprights 10. Conductive bolts 36 passing through the tubes 34 and extending through the webs of upright channel members 10 with nuts 38 at one end and heads at the other end hold the tubes firmly in position. The upper and lower tubes 34 and upper and lower bolts 36 are electrically insulated from the channel members 10 at both ends by the provision of circular cutouts 42 in the webs of the channel members 10 and the provision of dielectric plates 44 which overlie the cutouts 42, see FIG. 7. The intermediate two tubes 34 and bolts 36 are electrically connected to the channel members 10 of the frame which is suitably grounded when the device is installed.

Arranged along the tubes is a series of equally spaced metal collector plates 46, 48 and 50 arranged parallel to the ionizing wires 28 and extending from the ionizing section to the rear or outlet side of the device. The plates 46, 48 and 50 which comprise the collector section are preferably aluminum. All plates 46 are suitably connected mechanically and electrically to the upper and lower tubes 34 and are spaced from the two intermediate tubes 34 by the provision of circular cutouts 52 therein. All plates 48 and 50 are suitably connected mechanically and electrically to the two intermediate tubes 34 and are spaced from the upper and lower tubes 34 by the provision of circular cutouts 54 therein. Plates 48 and 50 are therefore electrically connected to the metal frame which is at ground potentential.

Figure 3:
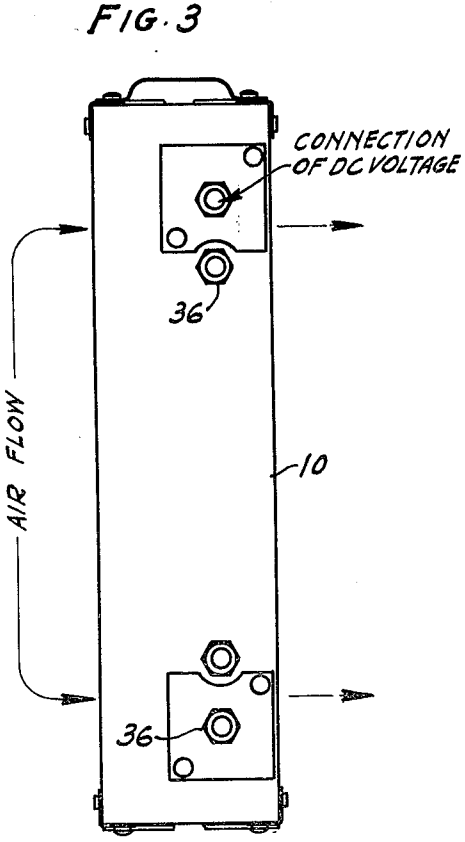
FIG. 3 is a side elevational view of the device shown in FIGS. 1 and 2.
Figure 1:
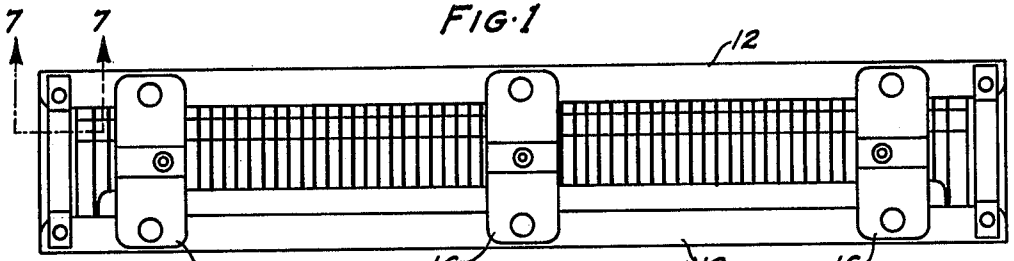
FIG. 1 is a top plan view of an electrostatic precipitator device constructed in accordance with the present invention.

When a D.C. voltage is applied to the upper tube 34 and bolt 36 at the point indicated in FIG. 3 all plates 46 and all ionizing wires 28 are energized at that voltage. A metal strap 56 spot welded to the end plate 46 and riveted to upper angle 20, see FIG. 5, provides an electrical connection between plate 46 and the ionizing wires 28.

Figure 8:
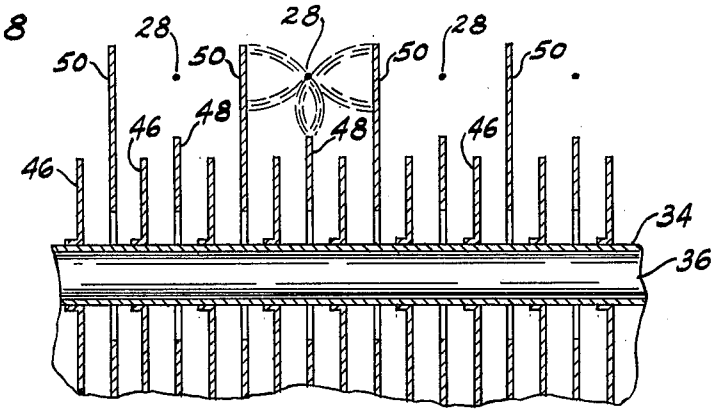
FIG. 8 is a fragmentary cross sectional view taken along line 8—8 of FIG. 5.
Figure 6:
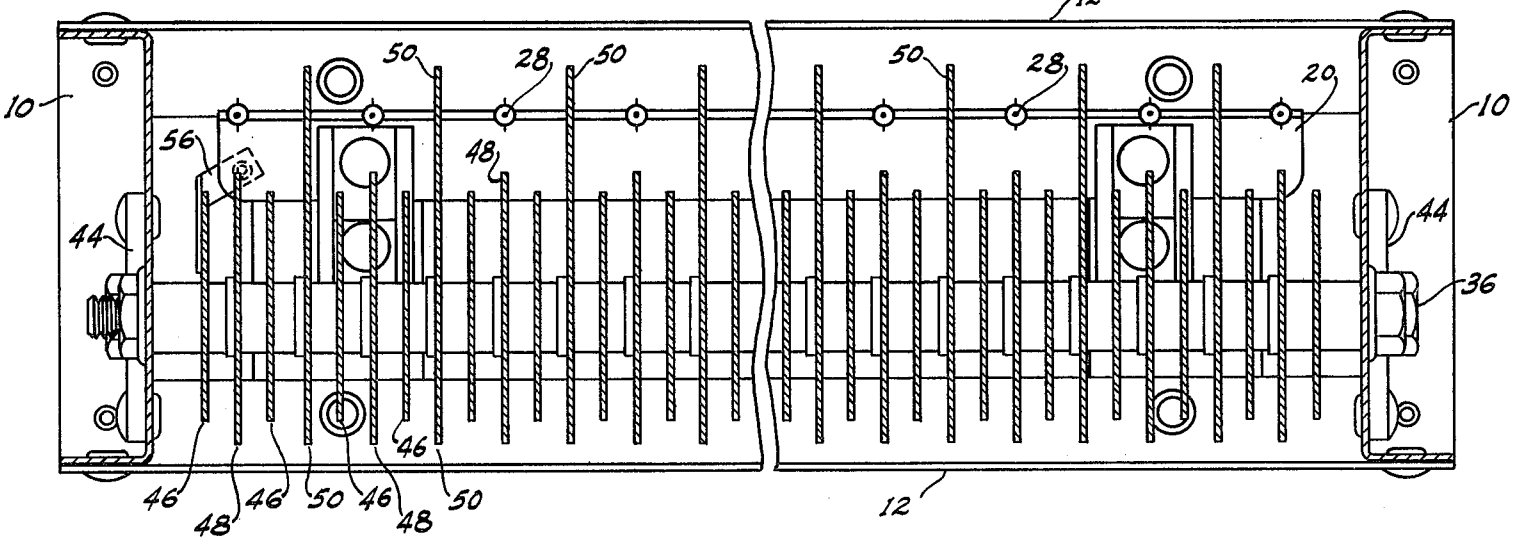
FIG. 6 is an enlarged cross sectional view taken along line 6—6 of FIG. 2.

Referring to FIGS. 6 and 8 there is a grounded or negative collector plate 50 lying equidistant on each side of each ionizing wire 28 and extending upward beyond the wires 28. When a sufficiently high D.C. voltage is applied to ionizing wires 28 an effective ionizing field will occur on each side of a wire 28 between the wire and the surfaces of the opposite plates 50 as indicated graphically in FIG. 8. There is also a grounded or negative collector plate 48 substantially in alignment with each wire 28. Negative plates 48 are extended upward to the extent that the upper ends or edges thereof are spaced from the wires 28 a distance equal to the distance from the wire 28 to the surfaces of the oppositely disposed plates 50. A third effective electrostatic ionizing field therefore occurs between the wire 28 and the upper parallel edge of the collector plate 48 as indicated graphically in FIG. 8 which substantially increases the effectiveness of the ionizing section of the device.

The positive collector plates 46 are smaller than the negative plates 48 and 50, their edges being spaced inwardly from these negative plates to preclude arcing between the edges of positive plates 46 and negative plates 48 and 50 when a relatively high voltage is applied to plates 46. This arrangement permits an optimum spacing of the collector plates when a single value voltage sufficiently high to result in effective ionization is applied to both the ionizing wires 28 and the positive collector plates 46. The increased area of the ionizing field provided by the extension of negative plates 48 and the higher voltage applied to the positive collector plates 46 results in more effective ionization and collection of particulate matter carried in an air stream passing through the device.

The foregoing description and accompanying drawings are intended to be illustrative, not limiting, the scope of the invention being set forth in the appended claims.

I claim:

1. In an electrostatic precipitator for cleaning an air stream, a metal casing having an inlet side and an outlet side, a length of ionizing wire in said casing extending across said casing adjacent said inlet side, five equally spaced metal collector plates in said casing arranged parallel with said wire and extending downstream from said wire to a point adjacent said outlet side of said casing, the outermost two of said plates being equally spaced on opposite sides of said wire and having portions thereof extending upstream toward said inlet side beyond said wire, the central one of said plates being in alignment with said wire and having its upstream edge spaced downstream from said wire a distance substantially equal to the distance from said wire to the surfaces of said upstream extended portions of said outermost plates, the remaining two of said plates having their upstream edges spaced downstream from the upstream edge of said central plate, means grounding said outermost two plates and said central plate at the same potential, means electrically insulating said wire and said remaining two plates from said two outermost plates and said central plate, and means electrically connecting said wire and said remaining two plates to the positive side of a D.C. power source to provide ionizing fields extending between said wire and said two outermost plates and between said wire and said central plate and for creating electrostatic fields between the surfaces of said remaining two plates and said outermost plates and between said remaining two plates and said central plate.

2. The device claimed in claim 1 having a plurality of parallel lengths of said ionizing wire, each of said parallel lengths of said wire having arranged therewith a group of said five metal collector plates with adjacent groups sharing an outermost plate.

3. An electrostatic precipitator comprising a metal casing having an inlet side and an outlet side, a plurality of equally spaced parallel metal plates supported in said casing and extending generally from said inlet to outlet sides of said casing, said plates being arranged in groups of five plates with adjacent groups sharing an outermost plate of each group, a plurality of ionizing wires supported in said casing adjacent said inlet side each being arranged parallel with and in alignment with the central plate of each group and being spaced upstream from the upstream edges of said central plates, the outermost two plates of each of said groups extending upstream beyond said wires, and the upstream edges of the remaining two plates of each of said groups being spaced downstream from the upstream edge of said central plate and the upstream spacing of said wires from the upstream edges of said central plates being equal to the spacing of said wires from the surfaces of said upstream extensions of said outermost plates, means insulating said wires and said remaining two plates from said central and said outermost plates and from said casing, means grounding said central and said outermost plates at the same potential, and means applying a D.C. voltage to said wires and said remaining two plates.

* * * * *